US006926267B2

(12) United States Patent
Kobayashi

(10) Patent No.: US 6,926,267 B2
(45) Date of Patent: Aug. 9, 2005

(54) SHEET TRANSPORT APPARATUS

(75) Inventor: Misao Kobayashi, Kofu (JP)

(73) Assignee: Nisca Corporation, Minamikoma-Gun (JP)

( * ) Notice: Subject to any disclaimer, the term of this patent is extended or adjusted under 35 U.S.C. 154(b) by 6 days.

(21) Appl. No.: 10/780,762

(22) Filed: Feb. 19, 2004

(65) Prior Publication Data

US 2004/0188912 A1 Sep. 30, 2004

(30) Foreign Application Priority Data

Mar. 31, 2003 (JP) ..... 2003-096522

(51) Int. Cl.[7] ..... B65H 85/00
(52) U.S. Cl. ..... 271/3.14; 271/171
(58) Field of Search ..... 271/3.14, 144, 271/171, 223; 399/370; 400/625

(56) References Cited

U.S. PATENT DOCUMENTS 3,311,371 A * 3/1967 Zeuthen ..... 271/240
5,366,216 A * 11/1994 Ahlvin ..... 271/171
5,377,966 A * 1/1995 Ohmori ..... 271/4.01
5,483,888 A * 1/1996 Greive ..... 101/232

OTHER PUBLICATIONS

Patent Abstracts of Japan, Publication No. 05–338926, Publication Date Dec. 21, 1993, Applicant Fuji Xerox Co., Ltd.
Patent Abstracts of Japan, Publication No. 2002–173243, Publication Date Jun. 21, 2002, Applicant Nisca Corporation.
Patent Abstracts of Japan, Publication No. 62–027240, Publication Date Feb. 5, 1987, Applicant Ricoh Co., Ltd.
Patent Abstracts of Japan, Publication No. 06–003898, Publication Date Jan. 14, 1994, Applicant Fuji Xerox Co., Ltd.

* cited by examiner

*Primary Examiner*—Donald P Walsh
*Assistant Examiner*—Kenneth W. Bower
(74) *Attorney, Agent, or Firm*—Manabu Kanesaka

(57) ABSTRACT

A sheet transport apparatus includes a paper feed stacker for stacking a sheet; a first sheet control device for abutting against an edge of the sheet to control a width direction of the sheet and being movable in the width direction; a discharge device for discharging the sheet transported from the paper feed stacker and processed at a predetermined processing unit; a discharge stacker arranged to overlap the paper feed stacker for stacking the sheet; and a second sheet control device for controlling the width direction of the sheet by abutting against the side edge of the sheet discharged to the discharge stacker and being synchronized to a movement of the first sheet control devices. The second sheet control device has a contact member rotatable between a position for controlling the sheet and a position where the sheet can be removed.

9 Claims, 4 Drawing Sheets

SHEET TRANSPORT APPARATUS

BACKGROUND OF THE INVENTION AND RELATED ART STATEMENT

The present invention relates to a sheet transport apparatus mounted on an image reading apparatus such as a facsimile machine and digital copier, or an image forming apparatus (hereinafter referred to as a sheet processing apparatus) that forms images on sheets (for example paper, film sheets or Mylar sheets). The sheet transport apparatus transports sheets stacked on a paper feed stacker to an image reading unit of the image reading apparatus or an image forming unit (hereinafter referred to as a processing unit) of the image forming apparatus, and discharges the processed sheets to a discharge stacker.

In general, a sheet processing apparatus is provided with a sheet transport apparatus having a paper feed stacker for stacking sheets and a discharge stacker for discharging the sheets as disclosed in, for example, Japanese Patent Publication No. 2002-173243. Transport means is provided between the paper feed stacker and discharge stacker for transporting the sheets from the paper feed stacker to the discharge stacker. Reading means is provided under a platen for reading an image on the sheet when the sheet is drawn out from the paper feed stacker and passes over the platen (sheet-through reading method). The paper feed stacker and discharge stacker are arranged adjacent to each other in the vertical direction for space conservation.

After the sheet is drawn out from the paper feed stacker and processed, the sheet is discharged consecutively to the discharge stacker by a pair of discharge rollers. In this case, it is preferred that the sheet is discharged in order with good alignment so that it is easy to align the sheets after being discharged. To this end, Japanese Patent Publication (Kokai) No. 05-338926 has disclosed a sheet controlling member integrally formed of a feed control unit for controlling a width direction of a sheet stacked on a paper feed stacker and a discharge control unit for controlling a width direction of a sheet discharged to a discharge stacker. The feed control unit has a pair of guide plates contacting both sides of the stacked sheet and being separated through an interlocking mechanism. The discharge control unit has substantially U-shaped side plates integrated with the pair of the guide plates. Also, the side plates of the discharge control unit are provided with widening portions at front edges thereof to control the sheet even when the sheet is discharged with a skew after being processed.

In the configuration disclosed in Japanese Patent Publication (Kokai) No. 05-338926, after the sheet is processed, the sheet is sequentially discharged between the pair of the side plates with a substantially U shape. The side plates only slide in the width direction along with the pair of the guide plates of the feed control unit to control the width of the sheet to be processed. Accordingly, when an operator takes out the sheet stacked on the discharge stacker, the operator needs to pull out the sheet in a direction same as that the sheet is discharged, thereby causing a problem in workability. Also, in order to remove the sheet in the direction same as that the sheet is discharged, it is necessary to provide an enough space in the discharge direction for the operation.

Also, when the processed sheet is discharged with a skew, the sheet abuts against the widening portion to be guided between the pair of the side plates. At this time, the sheet edge tends to crinkle or bend.

In view of the problems described above, the present invention has been made. A first object of the present invention is to provide a sheet transport apparatus that can align and order sheets discharged on a discharge stacker after being processed at a processing unit, in which it is easy to remove the stacked sheets with a limited space. A second object of the present invention is to provide a sheet transport apparatus that does not damage the discharged sheets.

Further objects and advantages of the invention will be apparent from the following description of the invention.

SUMMARY OF THE INVENTION

According to the present invention, a sheet transport apparatus comprises a paper or sheet feed stacker for stacking a sheet; first sheet control means for abutting against a side edge of the sheet stacked on the paper feed stacker to control a width direction of the sheet and being movable in the width direction; discharge means for discharging the sheet transported from the paper feed stacker and processed at a predetermined processing unit; a discharge stacker arranged to overlap the paper feed stacker for stacking the sheet discharged from the discharge means; and second sheet control means for controlling the width direction of the sheet by abutting against the side edge of the sheet discharged to the discharge stacker and being synchronized to a movement of the first sheet control means. The second sheet control means has a contact member for contacting the side edge of the discharged sheet. The contact member is configured to be rotatable between a position for controlling the sheet and a position (removal position) where the sheet can be removed.

With this configuration, the first sheet control means is operated to control the width direction of the sheet stacked on the paper feed stacker. The sheet stacked on the paper feed stacker is transported toward the predetermined processing unit. After the sheet is processed at the processing unit, the sheet is discharged to the discharge stacker. The second sheet control means is provided at the discharge stacker. The second sheet control means is synchronized to the first sheet control means and has the contact member that contacts the side edge of the sheet to be discharged. In this case, the side edge of the sheet abuts against the contact member to rotate. The contact member aligns and orders the sheet to be stacked sequentially through an action of returning. Also, the contact member is arranged to be rotatable to the removal position, so that the sheet can be removed easily in a stacked and aligned state in a direction perpendicular to a direction that the sheet is discharged.

According to the present invention, a sheet transport apparatus comprises a paper feed stacker for stacking a sheet; a pair of guide members for abutting against both side edges of the sheet stacked on the paper feed stacker to control a width direction of the sheet, at least one of the guide members movable in the width direction; discharge means for discharging the sheet transported from the paper feed stacker and processed at a predetermined processing unit; a discharge stacker arranged to overlap the paper feed stacker for stacking the sheet discharged from the discharge means; and a pair of contact members for abutting against the both side edges of the sheet discharged to the discharge stacker to control the width direction of the sheet, and being synchronized to a movement of the pair of the guide members. At least one of the pair of the contact members is configured to be rotatable in a direction substantially perpendicular to a direction that the sheet is discharged.

With this configuration, the pair of the guide members is operated to control the width direction of the sheet stacked on the paper feed stacker. The sheet stacked on the paper feed stacker is transported toward the predetermined processing unit. After the sheet is processed at the processing unit, the sheet is discharged to the discharge stacker. The pair of the contact members is provided at the discharge stacker. The pair of the contact members is synchronized to the pair of the guide members and contacts the both side edges of the sheet to be discharged. The contact members are operated to rotate in a direction perpendicular to the discharge direction, so that the sheet is removed in the width direction after sequentially stacked and aligned similar to the manner described above.

DETAILED DESCRIPTION OF PREFERRED EMBODIMENTS

Figure 1:
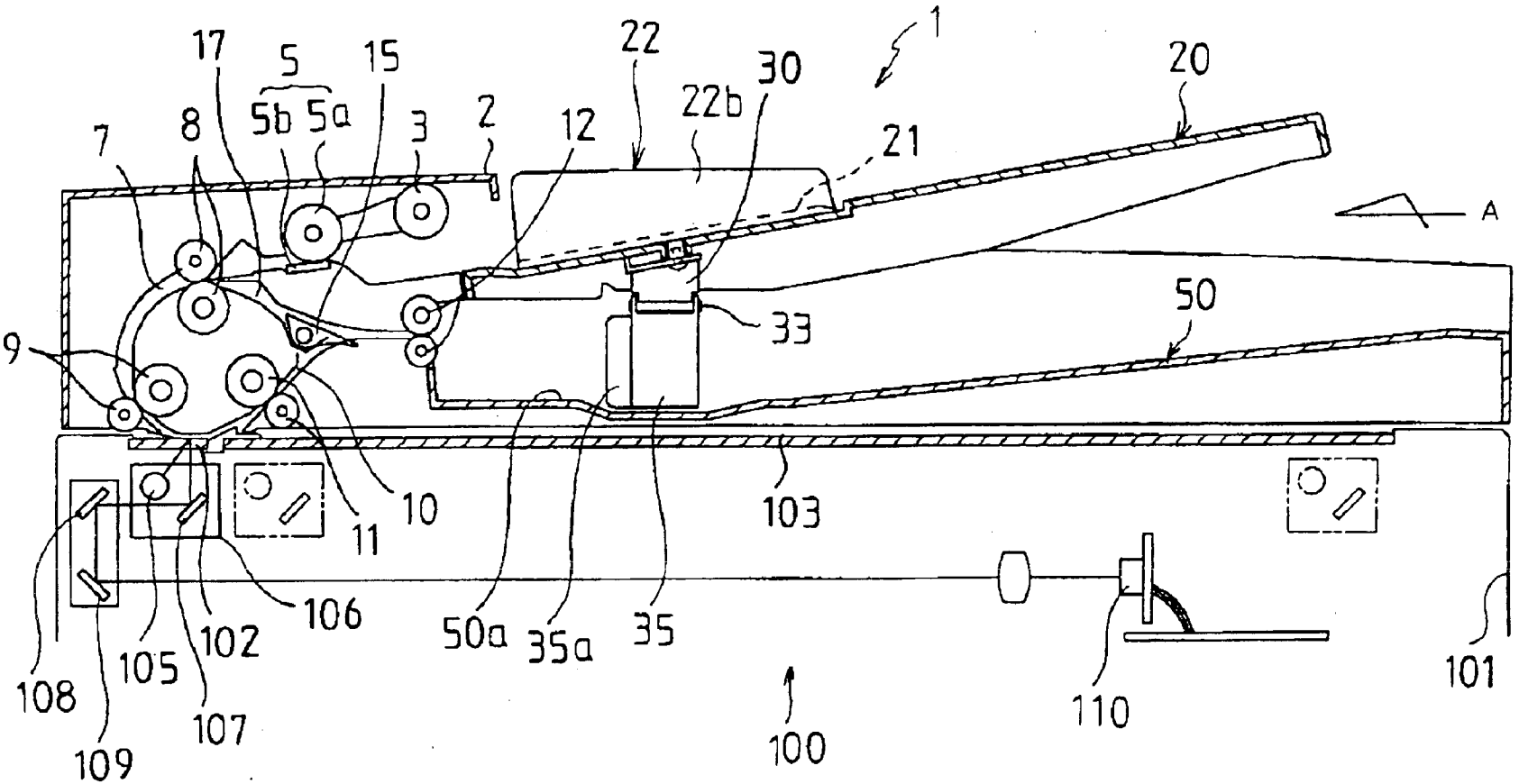
FIG. 1 is a schematic view showing a sheet transport apparatus mounted on an image reading apparatus or a sheet processing apparatus.

Hereunder, preferred embodiments of the present invention will be described in detail with reference to the accompanying drawings. FIG. 1 is a schematic view showing a sheet transport apparatus 1 mounted on an image reading apparatus 100 or a sheet processing apparatus. The image reading apparatus 100 is equipped with functions of reading moving sheets (originals) and stationary sheets. A first contact glass (first reading unit) 102 with a narrow width for reading the moving sheet and a second contact glass (second reading unit) 103 with a wide width for reading the stationary sheet are provided on a top surface of the apparatus main unit 101.

An optical unit 106 with a light source 105 for irradiating light on the sheets and reading means 110 such as a CCD for receiving the light reflected at the sheet from the optical unit 106 through a plurality of mirrors 107 to 109 are disposed in the apparatus main unit 101.

When the sheet transport apparatus 1 is used to read the sheets consecutively, the sheets pass over the first reading unit 102 consecutively (described later), so that the optical unit 106 below the first reading unit 102 performs the reading operation. When the sheet is stationary, the sheet transport apparatus 1 is rotated relative to the apparatus main unit 101 to open the second contact glass, and the sheets are placed on the glass where the reading operation is performed. In this case, the optical unit 106 is driven in a range specified by phantom line in FIG. 1 to scan an image on the sheet.

The sheet transport apparatus 1 is provided for feeding the sheet into the first reading unit 102 and discharging the sheet after the image thereupon is read. A paper feed stacker 20 for stacking the sheets and a discharge stacker 50 are arranged to overlap with each other in the vertical direction in the apparatus main unit 2, so that the sheets are continuously processed. The paper feed stacker and discharge stacker are described in detail later.

In the apparatus main unit 2, there are provided a kick roller 3 for drawing out the sheets stacked on the paper feed stacker 20; separating means 5 having a separation roller 5*a* and a separation pad 5*b* for separating the sheets into a single sheet; a transport path 7 for guiding the single sheet separated by the separating means 5 into the first reading unit 102; and transport rollers 8 and 9 arranged along the transport path 7. Discharge means is provided at a downstream side of the first reading unit 102. The discharge means is provided with a transport path 10 arranged in continuation to the transport path 7 for guiding the processed sheet toward the discharge stacker; a pair of transport rollers 11 arranged along the transport path 10 for transporting the sheet; and a pair of discharge rollers 12 for discharging the sheet to the discharge stacker 50.

A switchback path 17 is provided at a middle portion of the transport path 10, and is connected to the transport path 7 via the switching member 15. After a leading edge of the sheet is discharged to the discharge stacker, the sheet is guided to the switchback path 17 and returned to the transport path 7 so that both sides of the sheet are read.

Figure 2:
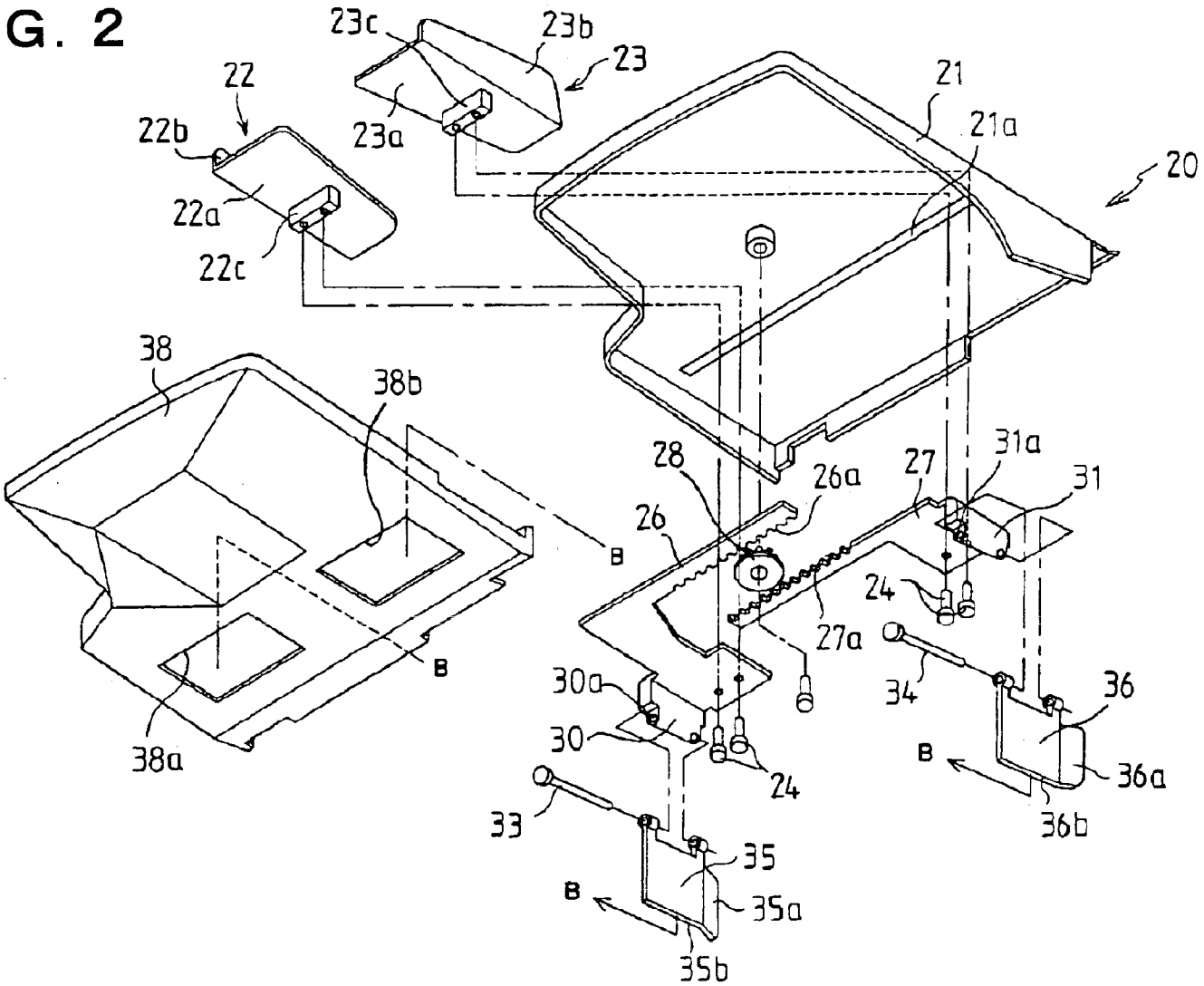
FIG. 2 is an exploded perspective view of a paper feed stacker of the sheet transport apparatus shown in FIG. 1.

Structures of the paper feed stacker 20 and the discharge stacker 50 disposed below will be explained next with reference to FIG. 1 and FIG. 2.

The paper feed stacker 20 is provided with a stacking plate 21 for stacking the sheets. The stacking plate 21 is provided with first control means for abutting against side edges of the stacked sheet to control a width direction of the sheet. The first control means is provided with a pair of guide members 22 and 23 for abutting against both side edges of the stacked sheet. It is arranged such that the guide members 22 and 23 approach or separate from each other when one of them is operated.

The guide members 22 and 23 are provided with supports 22*a* and 23*a* contacting a top surface of the stacking plate 21 and control portions 22*b* and 23*b* protruding perpendicular to the supports. The supports 22*a* and 23*a* have guide units 22*c* and 23*c* formed on bottom surfaces thereof for inserting to be guided in an elongated hole 21*a* formed in the stacking plate 21 extending in a horizontal direction. The guides units 22*c* and 23*c* have rack members 26 and 27 mounted on backsides thereof with stopper screws 24. The rack members 26 and 27 include racks 26*a* and 27*a* formed at opposing positions for engaging a pinion 28 rotatably mounted on the backside of the stacking plate.

With this configuration, the guides 22 and 23 are driven to approach or separate from each other relative to side edges of the stacked sheets through the engaging mechanism of the rack members 26*a* and 27*a* and the pinion when one of the guides is operated.

The rack members 27 and 27 move along with the guide members 22 and 23 in the width direction, and are provided with related second control means for controlling the sheets to be discharged to the discharge stacker. The second control means is provided with holding portions 30 and 31 having edges bending downwardly at outer sides thereof in the width direction of the rack members 26 and 27, and holding holes 30*a* and 31*a* formed in the edges and extending along a direction perpendicular to the width direction (longitudinal direction); and contact members (flappers) 35 and 36 having a substantially square shape and rotatably supported by fitting stopper screws 33 and 34 into the holding holes 30*a* and 31*a* in the holding portions 30 and 31.

In this case, the contact members 35 and 36 are supported by the stopper screws 35 and 36 and hang downwardly with their own weight. The contact members 35 and 36 are arranged at both sides of the discharge stacker 50 where the sheets are discharged so as to contact a predetermined range of the both sides at the side of the apparatus main unit of the discharging sheet. Note that it is preferable to form entrance widening portions 35*a* and 36*a* at leading edges of the contact members 35 and 36 at the sheet discharge side.

A cover 38 is mounted to a backside of the stacking plate 21 to protect the drive unit of the first control means. In this case, the cover 38 has openings 38*a* and 38*b* for allowing the contact members 35 and 36 to protrude therethrough, so that the holding portions 30 and 31 with the contact members 35 and 36 can move along with the movement of the guide members 22 and 23 in the width direction.

Figure 3:
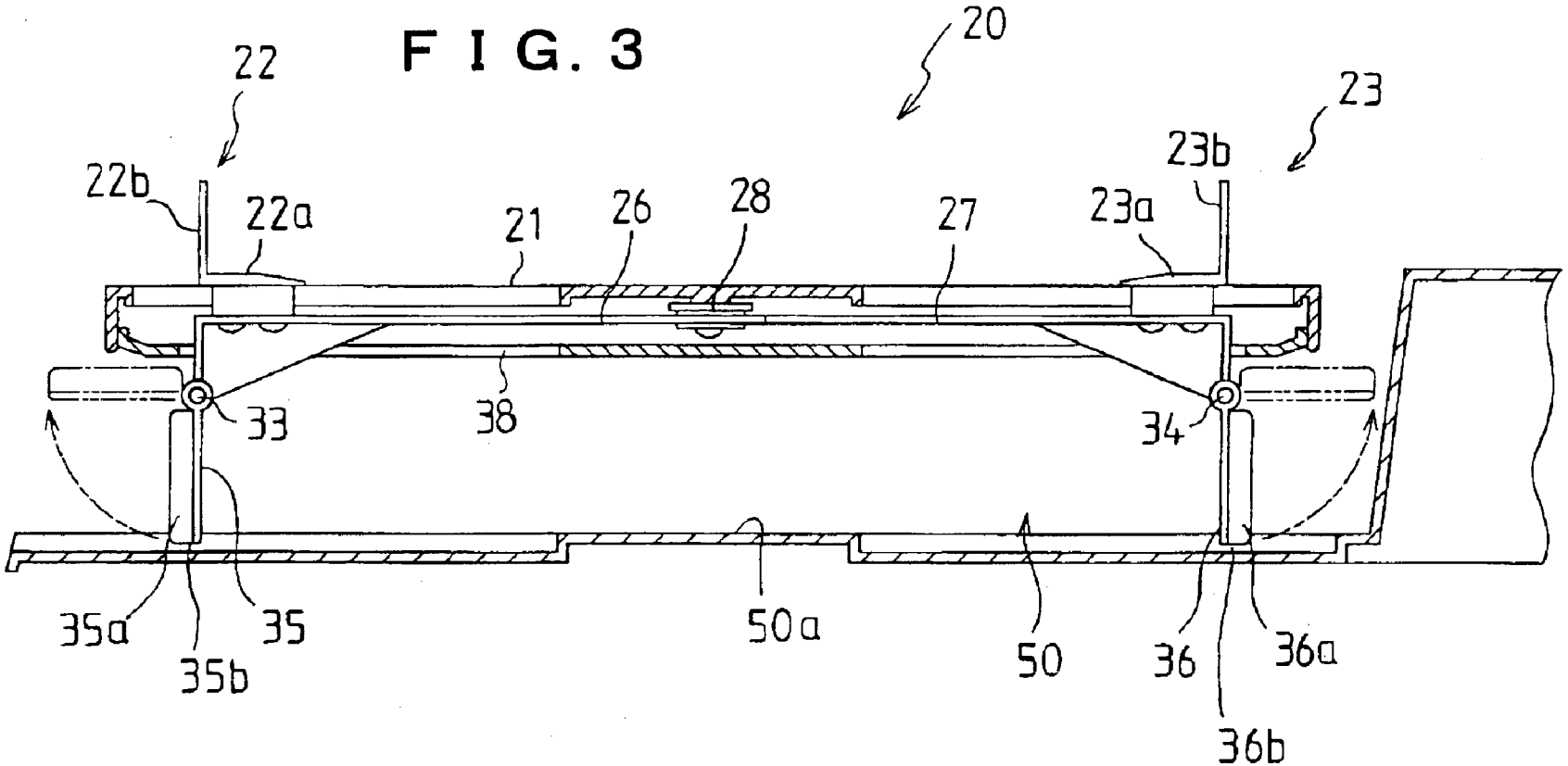
FIG. 3 is a view showing the sheet transport apparatus shown in FIG. 1 viewed from the arrow direction A.

FIG. 3 is a view seen from the arrow direction A in FIG. 1. With the configuration described above, the contact members 35 and 36 hang downwardly with their own weight and are rotatable in the direction indicated by the arrows at both sides in the width direction of the discharge stacker 50 disposed below the paper feed stacker 20. In this case, it is preferred that the entrance widening portions 35*a* and 36*a* of the contact members 35 and 36 are arranged below the stacking surface 50*a* of the discharge stacker 50. That is, with such an arrangement, the sheet does not slips into the lower edge portions 35*b* and 36*b* of the contact members 35 and 36, so that both sides of the discharged sheet can be securely controlled. Further, it is easy to remove the discharged and stacked sheet.

In the embodiment of the present invention, portions of the discharge stacker 50 are positioned at the lower edge portions of 35*b* and 36*b* of the contact members 35 and 36, and are formed in a shape protruding downwardly, so that the lower edge portions 35*b* and 36*b* protrude downwardly below the stacking surface.

An action of the sheet transport apparatus will be explained next with reference to FIG. 1 and FIGS. 4(*a*) and 4(*b*). The sheets to be processed are stacked on the stacking plate 21 of the paper feed stacker 20 in the sheet transport apparatus shown in FIG. 1. At this time, the guide members 22 and 23 are moved in the width direction according to a size of the sheets to control both sides thereof. Along with this action, the contact members 35 and 36 protruding toward the discharge stacker 50 are also moved to aligning discharge positions for controlling both sides of the discharging sheets in the width direction in synchronization due to the aforementioned configuration.

Then, the stacked sheets are sequentially drawn out according to a processing instruction from the image reading apparatus 100, and the reading operation is performed at the first reading unit 102. After the sheets are read (including both sides of the switched back sheets), the sheets are consecutively discharged to the stacking surface 50*a* of the discharge stacker 50 via the pair of the discharge rollers 12.

Figure 4:
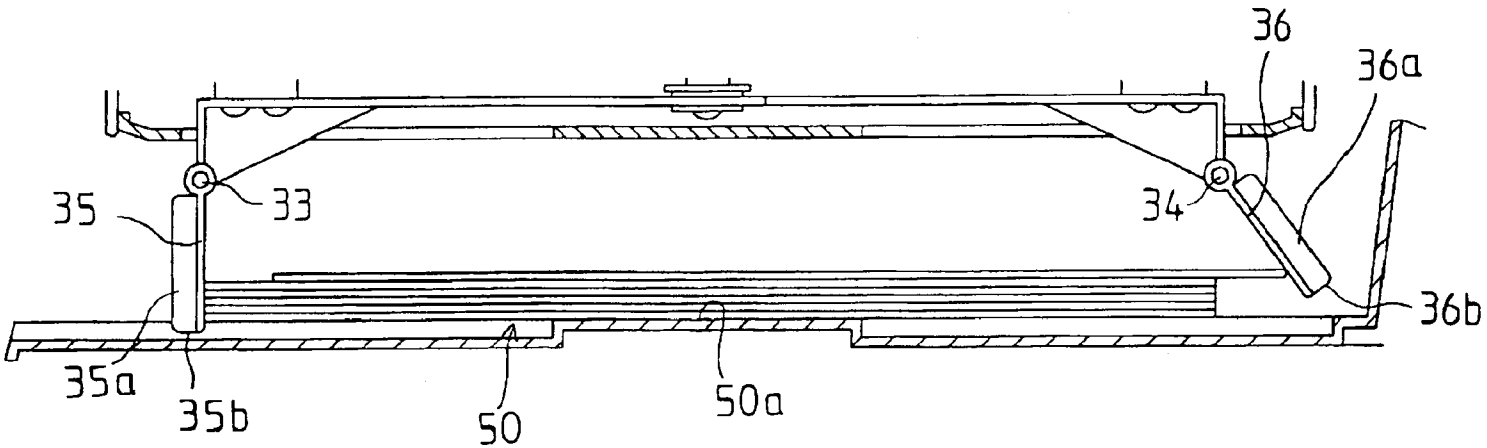
FIGS. 4(*a*) and 4(*b*) are views showing the sheet transport apparatus shown in FIG. 1 viewed from the arrow direction A, wherein FIG. 4(*a*) shows a state that a discharged sheet abuts against a contact member, and FIG. 4(*b*) shows a state that the contact member returns a skewed sheet.
Figure 4:
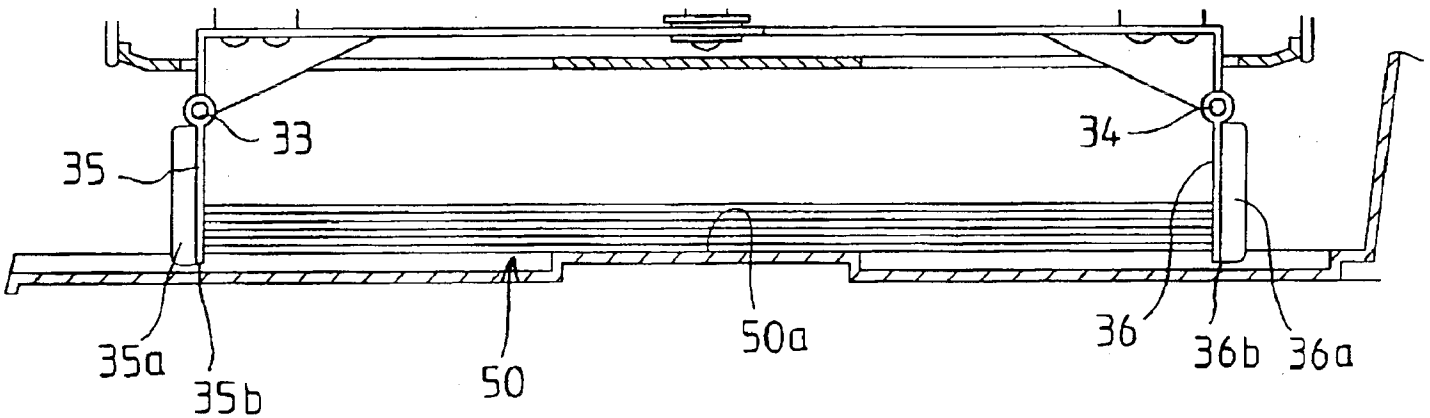

At this time, when the sheet is discharged with a skew as shown in FIG. 4(*a*), the sheet abuts against a part of one of the contact members 35 and 36 (i.e. the entrance widening portions 35*a* and 36*a*) that control the both sides, so that the one of the contact members is rotated toward the outside direction. The one of the contact members returns to a position as shown in FIG. 4(*b*) with its own weight, thereby aligning the sheet. Moreover, when the sheet is discharged with a skew, the sheet abuts against the rotatable contact members, thereby preventing damage such as bending the sheet.

Note that the contact members 35 and 36 have a weight to be rotatable with firmness of the sheet and returnable to the aligning position with their own weight as shown in FIG. 4(*b*). In this case, it is possible to provide urging means, for example a coiled spring disposed between the stopper screws 33 and 34, for urging the side edges of the sheets in the alignment direction, so that the sheet is effectively returned to the alignment position.

With this configuration, the contact member 35 can be rotated in a direction perpendicular to the discharge direction, i.e. toward a front side seen from an operator, so that it is easy to remove the sheets stacked on the discharge stacker 50. In other words, in the conventional apparatus, the sheets are removed in the discharge direction. On the other hand, in the apparatus of the invention, it is possible to remove the sheet by rotating the contact member and pulling out toward the front side, thereby reducing a space and making it easy to remove the sheet.

Moreover, the portions of the discharge stacker 50 positioned at the lower edge portions of 35*b* and 36*b* of the contact members 35 and 36 are formed in the shape protruding downwardly. Accordingly, it is easy to grab the stacked sheets, thereby making it easy to remove the sheet.

As shown in FIG. 1, the contact members have a length enough to contact the sheet in a short range in the longitudinal direction thereof, i.e. to be rotatable with the firmness of the sheet. With this configuration, it is easy to remove the sheet. Note that a plurality of contact members may be provided in the discharge direction.

The specific embodiment of the invention has been described above, and it is possible to apply the invention to further embodiments other than the embodiment described above. The sheet transport apparatus may be mounted to the sheet processing apparatus as a separate unit as described above, or may be mounted as a part of the unit. A predetermined processing unit may be provided as a part of the sheet transport apparatus.

As described above, the guide members 22 and 23 are disposed on the paper feed stacker, and move in synchronization in the width direction. Alternatively, it is arranged that only one of the guide members 22 and 23 move in the width direction. In this case, it is preferable to configure that the one of the guide members is positioned at the front side of the operator to make it easy to remove the sheet after being discharged. According to the configuration described above, the paper feed stacker is arranged at the upper side, and the discharge stacker is arranged at the lower side. Alternatively, the paper feed stacker and the discharge stacker are arranged in the opposite way. In this case, since the contact members do not rotate with their own weight, urging means is provided for controlling the rotational state thereof.

The contact members 35 and 36 are configured to be rotatable between the sheet controlling position and the sheet removal position. It may be arranged that at least one of the contact members (at the side for the sheet removal) is rotatable. Also, the contact members are rotatable in the direction perpendicular to the discharge direction. Alternatively, the contact members may be rotatable in an inclined direction (including a substantially perpendicular direction).

While the invention has been explained with reference to the specific embodiments of the invention, the explanation is illustrative and the invention is limited only by the appended claims.

What is claimed is:

1. A sheet transport apparatus for transporting a sheet, comprising:

a sheet feed stacker for stacking the sheet, first sheet control means disposed on the sheet feed stacker and movable in a width direction of the sheet for abutting against at least one edge of the sheet stacked on the sheet feed stacker to control the width direction of the sheet, discharge means disposed adjacent to the sheet feed stacker for discharging the sheet transported from the sheet feed stacker and processed at a predetermined processing unit, a discharge stacker disposed adjacent to the discharge means and arranged to overlap with the sheet feed stacker for stacking the sheet discharged from the discharge means, and second sheet control means disposed on the discharge stacker and movable along with the first sheet control means for abutting against at least one edge of the sheet discharged to the discharge stacker to control the width direction of the sheet, said second sheet control means having a contact member rotatable between a first position for contacting the at least one edge of the sheet to control the sheet and a second position away from the sheet for allowing the sheet to be taken out from the discharge stacker.

2. A sheet transport apparatus according to claim 1, wherein said discharge stacker is arranged below the sheet feed stacker, and said contact member is supported by the first sheet control means such that the contact member hangs downwardly with its own weight.

3. A sheet transport apparatus according to claim 1, wherein said second sheet control means further includes urging means for urging the contact member in a direction that the contact member contacts the edge of the sheet.

4. A sheet transport apparatus according to claim 1, wherein said contact member has a lower edge portion positioned below a sheet stacking surface of the discharge stacker.

5. A sheet transport apparatus according to claim 1, wherein said first sheet control means includes a pair of guide members for abutting against two side edges of the sheet, at least one of said guide members being movable in the width direction.

6. A sheet transport apparatus according to claim 5, wherein said second sheet control means includes two contact members movable along with the pair of the guide members for abutting against the two side edges of the sheet, at least one of said contact portions being rotatable in a direction substantially perpendicular to a direction that the sheet is discharged.

7. A sheet transport apparatus according to claim 6, wherein said discharge stacker is arranged below the sheet feed stacker, and said contact portions are supported on the guide members to hang downwardly with their own weight.

8. A sheet transport apparatus according to claim 6, further comprising urging means for urging the contact portions in a direction that the contact portions contact the two side edges of the sheet.

9. A sheet transport apparatus according to claim 6, wherein said contact portions have lower edge portions positioned below a sheet stacking surface of the discharge stacker.

* * * * *